US009453712B2

(12) United States Patent
Hong

(10) Patent No.: US 9,453,712 B2
(45) Date of Patent: Sep. 27, 2016

(54) GAME APPARATUS AND GAME DATA AUTHENTICATION METHOD THEREOF

(75) Inventor: Sang Uk Hong, Seoul (KR)

(73) Assignee: HONG INTERNATIONAL CORP., Seoul (KR)

( * ) Notice: Subject to any disclaimer, the term of this patent is extended or adjusted under 35 U.S.C. 154(b) by 1001 days.

(21) Appl. No.: 13/392,211

(22) PCT Filed: Aug. 25, 2010

(86) PCT No.: PCT/KR2010/005681
§ 371 (c)(1),
(2), (4) Date: Jun. 6, 2012

(87) PCT Pub. No.: WO2011/025250
PCT Pub. Date: Mar. 3, 2011

(65) Prior Publication Data

US 2012/0242043 A1 Sep. 27, 2012

(30) Foreign Application Priority Data

Aug. 25, 2009 (KR) ..... 10-2009-0078647

(51) Int. Cl.

| | |
|---|---|
| ***F41J 5/02*** | (2006.01) |
| ***F41J 3/00*** | (2006.01) |
| ***F41J 5/24*** | (2006.01) |
| ***F41J 3/02*** | (2006.01) |
| ***F41J 5/14*** | (2006.01) |

(52) U.S. Cl.
CPC .. *F41J 5/24* (2013.01); *F41J 3/02* (2013.01); *F41J 5/14* (2013.01)

(58) Field of Classification Search
CPC ..... F41J 5/02; F41J 3/00
USPC ..... 463/1, 7, 25, 42; 273/348, 371
See application file for complete search history.

(56) References Cited

U.S. PATENT DOCUMENTS 5,980,254 A * 11/1999 Muehle et al. ..... 434/11
6,038,599 A * 3/2000 Black ..... H04L 12/2602 709/223

(Continued)

FOREIGN PATENT DOCUMENTS

CA GB 2430895 A * 4/2007 ..... F41J 3/02
JP 2006-280527 10/2006

(Continued)

OTHER PUBLICATIONS

Korean Office Action for Application No. KR 10-2009-0078647 dated Sep. 18, 2012.

(Continued)

*Primary Examiner* — Jason Skaarup
(74) *Attorney, Agent, or Firm* — Hauptman Ham, LLP

(57) ABSTRACT

A game apparatus includes: a target including a plurality of sections divided according to a predetermined principle; a camera unit including a first camera and a second camera, the first camera being arranged to photograph at least a part of a game participant, the second camera being arranged to photograph at least a part of the target; a memory for storing at least a part of dynamic images photographed by the first camera and the second camera; a network connection unit for transmitting the dynamic images stored in the memory to a network; and a control unit for controlling operations of the first camera and the second camera and transmission of the dynamic images.

19 Claims, 8 Drawing Sheets

(56) References Cited

U.S. PATENT DOCUMENTS

| | | | | |
|---|---|---|---|---|
| 6,373,508 | B1 * | 4/2002 | Moengen | 715/848 |
| 8,113,930 | B1 * | 2/2012 | Coats | F41J 3/0019 273/333 |
| 2005/0043088 | A1 * | 2/2005 | Nguyen et al. | 463/29 |
| 2005/0075153 | A1 * | 4/2005 | Valero Moreno | 463/1 |
| 2005/0121855 | A1 * | 6/2005 | Noda et al. | 273/348 |
| 2006/0015739 | A1 * | 1/2006 | Suzuki | G07C 9/00111 713/182 |
| 2006/0066053 | A1 * | 3/2006 | Skala | F41J 3/02 273/348 |
| 2013/0196727 | A1 * | 8/2013 | Barney et al. | 463/7 |

FOREIGN PATENT DOCUMENTS

| | | | |
|---|---|---|---|
| JP | 2007-502658 | A | 2/2007 |
| KR | 10-1997-0705734 | A | 10/1997 |
| KR | 10-2003-0066283 | | 8/2003 |
| KR | 10-2007-0062658 | A | 6/2007 |
| KR | 10-0824354 | | 4/2008 |

OTHER PUBLICATIONS

International Search Report for International Application No. PCT/KR2010/005681 mailed Feb. 25, 2011.

Korean Office Action for Patent Application No. 10-2009-0078647 dated Feb. 11, 2011.

Korean Office Action for Patent Application No. 10-2009-0078647 dated Nov. 16, 2011.

* cited by examiner

GAME APPARATUS AND GAME DATA AUTHENTICATION METHOD THEREOF

This application is a U.S. National Phase Application of PCT International Application No. PCT/KR2010/005681, filed Aug. 25, 2010. The contents of this application are incorporated herein by reference.

TECHNICAL FIELD

The present invention relates to a game apparatus using a communication network, and more particularly, to a game apparatus enabling game players existing in different spaces or at different times to enjoy a game together.

BACKGROUND ART

A game refers to an activity done in competition, which is performed according to a predetermined rule. As Johan Huizinga, a Dutch cultural historian, has defined humans as "Homo Ludens", the game has a close relationship to human culture. Humans have a long history of developing and enjoying various kinds of games. Such various kinds of games include games for competition of physical ability (usually called "sports"), such as soccer, baseball, and golf, games for competition of mental ability, such as baduk, chess, and card game, and games for competition of both physical ability and strategic ability, such as a dart game.

In general, those who want to enjoy a game have been required to participate in the game at the same time and in the same place. However, the recent development of communication technology has enabled each participant of a game to individually join the game from a remote distance and transmit their own game play or a result of the play through a communication network to a remote server. As a result, it has become possible for participants of a game to participate in the game without temporal or spatial restrictions.

In the case in which participants of a game transmit results of their performance through a communication network to enjoy the game, it is recommendable to guarantee a fair game by allowing at least a part of the participants or a third party to observe a process or result of the performance of a counterpart player.

DISCLOSURE

Technical Problem

Therefore, the present invention has been made in view of the above-mentioned problems, and an aspect of the present invention is to store visual information relating to a game procedure or performance results of game participants and transmit the stored visual information through a network, so that the game participants or a third party can determine the fairness of the game.

Technical Solution

In accordance with an aspect of the present invention, there is provided a game apparatus including: a target including a plurality of sections divided according to a predetermined principle; a camera unit including a first camera and a second camera, the first camera being arranged to photograph at least a part of a game participant, the second camera being arranged to photograph at least a part of the target; a memory for storing at least a part of dynamic images photographed by the first camera and the second camera; a network connection unit for transmitting the dynamic images stored in the memory to a network; and a control unit for controlling operations of the first camera and the second camera and transmission of the dynamic images.

In accordance with another aspect of the present invention, there is provided a method for authenticating game data of a game apparatus, the method including: photographing at least a part of game participants and at least a part of a target including a plurality of sections divided according to a predetermined principle; storing at least a part of photographed dynamic images; and transmitting the stored dynamic images to a network.

In accordance with another aspect of the present invention, there is provided a computer-readable recording medium in which a program exists for executing the method for authenticating game data of a game apparatus as described above.

Advantageous Effects

A game apparatus having the construction according to at least one embodiment of the present invention as described above stores dynamic images, by which it is possible to determine whether a game participant having participated in a game from a remote distance makes an illegal action, and transmits the stored dynamic images to a network server, so that another game participant or a third party can identify the fairness of the game in the future.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Various aspects are now described with reference to the drawings. In the following description, for purposes of explanation, numerous specific details are set forth in order to provide a thorough understanding of one or more aspects. It may be evident, however, that the various aspects may be practiced without these specific details. In other instances, well-known structures and devices are shown in block diagram form in order to facilitate describing these aspects.

As used in this application, the terms "component", "module", "system", and the like are intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers. Also, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal).

Further, various aspects or characteristics presented herein may be implemented by a produced article using a method, apparatus, or a standard and/or engineering technology. The term "produced article" includes media, a carrier, or a program, which can be accessed by any computer-readable apparatus. For example, the computer-readable apparatus includes, but is not limited to, a magnetic storage device (e.g. a hard disc, a floppy disc, a magnetic strip, etc.), an optical disc (e.g. CD, DVD, etc.), a smart card, and a flash memory device (e.g. EEPROM, card, stick, key drive, etc.). Moreover, various storage media presented herein include one or more apparatus for storing information and/or other machine-readable mediums. The term "machine-readable medium" includes, but is not limited to, a wireless channel capable of storing, possessing, and/or transferring command(s) and/or data, and various other media.

A game apparatus described herein may be one of an electronic dart game machine, a screen golf game machine, an electronic shooting game machine, a game machine for sports, such as basketball, soccer, and baseball, which can electronically collect scores, and other game machines, each of which can electronically collect scores and is connected to a network.

Figure 1:
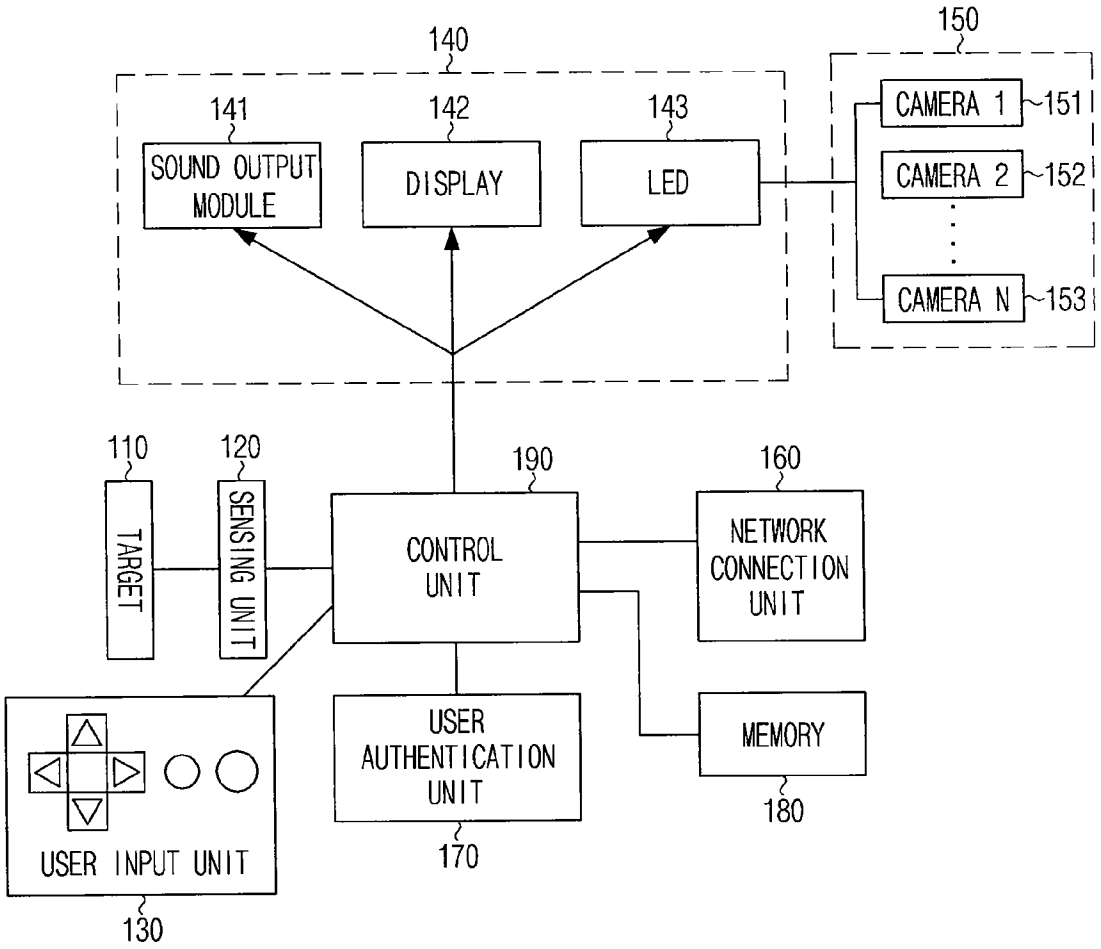
FIG. 1 is a block diagram of a game apparatus according to an embodiment of the present invention.

FIG. 1 is a block diagram of a game apparatus according to an embodiment of the present invention.

The game apparatus 100 may include a target 110, a sensing unit 120, a user input unit 130, an output unit 140, a camera unit 150, a network connection unit 160, a user authentication unit 170, a memory 180, and a control unit 190. The elements shown in FIG. 1 are not indispensable, so a mobile terminal having more elements or fewer elements may be implemented.

Hereinafter, those elements will be sequentially discussed.

The target 110 includes sections assigned individual scores according to a game rule of a game corresponding to the game apparatus 100, so as to enable a performance of a participant of the game to be scored. For example, if the game corresponding to the game apparatus 100 is a dart game, the target 110 may be a score board including a plurality of sections, which are assigned individual scores and are divided by concentric circles around a bullseye located at a center thereof and straight lines extending radially outward. A plurality of holes, in each of which a tip of a dart may be fitted, may be arranged on the score board.

The target 110 may include a display 142, by which it is possible to adaptively change the arrangement of scores on the target 110 and the shapes of the sections assigned the scores. The display 142 will be described later in more detail. In this event, the target 110 may have a structure of a touch screen including light transmissive touch pads stacked on the display 142.

The sensing unit 120 detects a performance of a game participant performed with respect to the target 110 and evaluates the performance of an actual game participant. For example, in the case of a dart game, when a game participant has performed an action of throwing a dart, the sensing unit 120 may detect the section in which the thrown dart is stuck. The sensing unit 120 may electrically convert the score corresponding to the section in which the dart is stuck, and then transmit the converted score to the control unit 190.

The user input unit 130 receives an input of a user for the control of the game apparatus 100. The user input unit 130 may include a key pad, a dome switch, a touch pad (resistive overlay type/capacitive overlay type), a jog wheel, or a jog switch. The user input unit 130 may also include a camera 151, . . . , and 153 or a microphone.

Through the user input unit 130, the user may select a game mode, the number of game participants, a game play type, etc. For example, in the case of a dart game, the user may select the number of players, a game play type (501 game, cricket game, etc.), or a game mode (single play, network play, etc.), through the user input unit 130. The user input unit 130 may receive a signal by detecting a key handling or a touch input by a user, or may receive a voice or an operation through a microphone and then convert the received voice or operation to an input signal. To this end, conventional speech recognition technologies or motion recognition technologies known to the public may be used.

The output unit 140 is a unit for generating an output relating to a visual sense, an auditory sense, or a tactile sense and may include a sound output module 141, a display 142, and a notification unit 143.

The sound output module 141 may output audio data received from the network connection unit 160 or stored in the memory 180 in relation to the effect sound of a game, a game operation guide, and description of a game play method. The sound output module 141 may output a sound signal (e.g. game effect sound) relating to the functions executed by the game apparatus 100. Also, the sound output module 141 may output a voice of a third party or a game participant using another game apparatus 200 (see FIG. 2) received through the network connection unit 160. The sound output module 141 may include a receiver, a speaker, a buzzer, etc.

The display 142 displays (outputs) information processed by the game apparatus 100. For example, when the game apparatus 100 is in a game play type guide mode, the display 142 may output selectable game play types. While the game apparatus 100 is executing a game play, the display 142 may display the score detected by the sensing unit 120 or an image obtained by taking a picture of a third party or a game participant using another game apparatus 200 (see FIG. 2) received through the network connection unit 160.

The display 142 may include one or more combinations of a liquid crystal display (LCD), a thin film transistor-liquid crystal display (TFT LCD), an organic light-emitting diode (OLED), a flexible display, and a three dimensional (3D) display.

Among these displays, some displays may be transparent or light transmissive type displays, through which it is possible to view an outside of the displays. These displays may be collectively referred to as transparent displays, a representative example of which is a transparent OLED (TOLED).

According to the implementation type of the game apparatus 100, the game apparatus 100 may include two or more displays 142. For example, the game apparatus 100 may include a plurality of displays arranged on one surface while being either integrated with each other or spaced apart from each other or a plurality of displays arranged on different surfaces.

The touch sensor may be configured to convert a change in a pressure applied to a particular portion of the display 142 or a capacitance generated at the particular portion of the display 142 to an electrical input signal. The touch sensor may be configured to be capable of detecting not only the touched position and touched area but also the pressure of the touching.

When there is a touch input with respect to the touch sensor, a signal or signals corresponding to the touch input are sent to a touch controller. The touch controller processes the signal or signals and then transmits corresponding data to the control unit 190. As a result, the control unit 190 can obtain information on which part of the display 142 has been touched.

The notification unit 143 outputs a signal for notifying an occurrence of an event of the game apparatus 100. In the case of a dart game, examples of events, which may occur in the game apparatus 100, include a hit on a target, a change of a game participant, a game closing, etc. The notification unit 143 may output another type of signal other than a video signal or an audio signal, for example, it may output a signal for notifying of occurrence of an event through vibration. The alarm unit 143 may include a Light Emitting Diode (LED), which can notify a user of the occurrence of an event through flickering of an LED.

The camera unit 150 includes a plurality of cameras 151, . . . , and 153, and an image frame processed by the cameras 151, . . . , and 153 may be either stored in the memory 180 or transmitted to the outside through the network connection unit 160. The camera unit 150 may include two or more cameras according to the use environment.

At least a part of the cameras of the camera unit 150 may be arranged to photograph an image frame including a target 110, while another part of the cameras of the camera unit 150 are arranged to photograph an image frame directly related to a game rule for the game play. For example, in order to photograph an image frame directly related to a game rule, the cameras may be arranged to be capable of photographing at least a part of a throw line for throwing a dart in the case of a dart game, a shooting line for firing in the case of a shooting game, a tee for taking a tee shot in the case of a golf game, or a throw line for throwing a ball in the case of a basketball game. The plurality of cameras 151, . . . , and 153 included in the camera unit 150 may be arranged to photograph image frames which overlap at least partially on each other.

When the camera unit 150 includes only one camera, the camera may be a panorama camera disposed to be capable of photographing all image frames (for example, a throw line in a dart game) directly relating to the game rule and at least a part of the target 110.

The network connection unit 160 may include one or more modules, which enable wireless communication between the game apparatus 100 and a network in which the game apparatus 100 is located or between the game apparatus 100 and a wired or wireless communication system.

The network connection unit 160 may include a wired/wireless Internet module for network access. As a wireless Internet technology, WLAN (Wireless LAN), Wi-Fi, Wibro (Wireless broadband), Wimax (World Interoperability for Microwave Access), HSDPA (High Speed Downlink Packet Access), etc. may be used. As a wired Internet technology, XDSL (Digital Subscriber Line), FTTH (Fibers to the home), PLC (Power Line Communication), etc. may be used.

Further, the network connection unit 160 includes a short range communication module, which enables the game apparatus 100 to transmit or receive data to or from an electronic apparatus, which is located relatively near to the game apparatus 100 and includes a short range communication module. As the short range communication technology, Bluetooth, RFID (Radio Frequency Identification), IrDA (infrared Data Association), UWB (Ultra Wideband), ZigBee, etc. may be used. The network connection unit 160 may detect the connection state of the network and the transmission or reception speed of the network.

The data received through the network connection unit 160 may be output through the output unit 140, may be stored by the memory 180, or may be transmitted through the short range communication module to another electronic apparatus located in a vicinity of the game apparatus 100.

The user authentication unit 170 recognizes specific information of a user in a remote distance through electronic waves by using an RFID (Radio Frequency Identification) technology, which is a kind of short range communication technology. For example, a user may possess a card, a mobile terminal, or a specific game apparatus (e.g. a personal dart apparatus possessed by the user), which includes an RFID module. Information identifying the user, for example, a personal identifier (ID) or identification code of the user registered in a database server (DB server; see FIG. 2), may be recorded in the RFID module possessed by the user. By identifying the RFID module possessed by the user, the game apparatus 100 may identify a game participant, who plays the game by using the game apparatus 100, and may update the database or accumulate a new database in relation to the identified game participant.

The user authentication unit 170 may include, in addition to the RFID technology, various technologies (for example, a short range communication technology, such as Bluetooth) capable of transmitting or receiving specific information of a user according to a contact scheme or a non-contact scheme. Further, the user authentication unit 170 may include a biological data identification module for identifying biological data (voice, fingerprint, or face) of a user in interworking with a microphone, a touch pad, or the camera unit 150.

The memory 180 may store a program for the operation of the control unit 190, and may temporarily store input or output data, such as a phonebook, a message, a still image, or a dynamic image. The memory 180 may store data relating to sound or vibration of various patterns output when a touch input on the touch screen occurs.

The memory 180 may include one or more types of storage mediums among a flash memory type storage medium, a hard disk type storage medium, a multimedia card micro type storage medium, a card type storage medium (e.g. SD or XD memories, etc.), a Random Access Memory (RAM) type storage medium, an SRAM (Static Random Access Memory) type storage medium, Read-Only Memory (ROM) type storage medium, an EEPROM (Electrically Erasable Programmable Read-Only Memory) type storage medium, a PROM (Programmable Read-Only Memory) type storage medium, a magnetic memory type storage medium, a magnetic disc type storage medium, and an optical disc type storage medium. The game apparatus 100 may operate in relation to a web storage performing a storage function of the memory 180 on the Internet.

The control unit 190 controls the general operation of the game apparatus 100. For example, in the case of a dart game, the control unit 190 collects scores of individual game participants detected by the sensing unit 120, transmits or receives the collected scores to or from another game apparatus 200 connected through a network, and records the scores or makes a win/lose record based on the collected scores.

The control unit 190 may perform a pattern recognition processing, by which an input of an operation or hand writing performed on the touch screen or a camera can be recognized as letters or images. Further, the control unit 190 may perform a speech recognition function by using a Speech-To-Text (STT) function, by which a voice input through the microphone can be recognized as letters.

Various embodiments described herein may be implemented in, for example, a recording medium readable by a computer or an apparatus similar to the computer by using software, hardware, or some combinations thereof.

In the implementation using hardware, the embodiments described herein may be implemented using at least one of ASICs (application specific integrated circuits), DSPs (digital signal processors), DSPDs (digital signal processing devices), PLDs (programmable logic devices), FPGAs (field programmable gate arrays, processors, controllers, microcontrollers, microprocessors, and other electric units for execution of functions. In some cases, the embodiments described in the present specification may be implemented by the control unit 190 itself.

In the implementation using software, the embodiments relating to the procedures and functions described in the present specification may be implemented by separate software modules. Each of the software modules may perform at least one function and operation described in the present specification. Software codes may be implemented by a software application written in a proper program language. The software code may be stored in the memory 180 and may be executed by the control unit 190.

Hereinafter, a more detailed description on the connection of a game apparatus according to an embodiment of the present invention with a network will be given with reference to the attached drawings.

Figure 2:
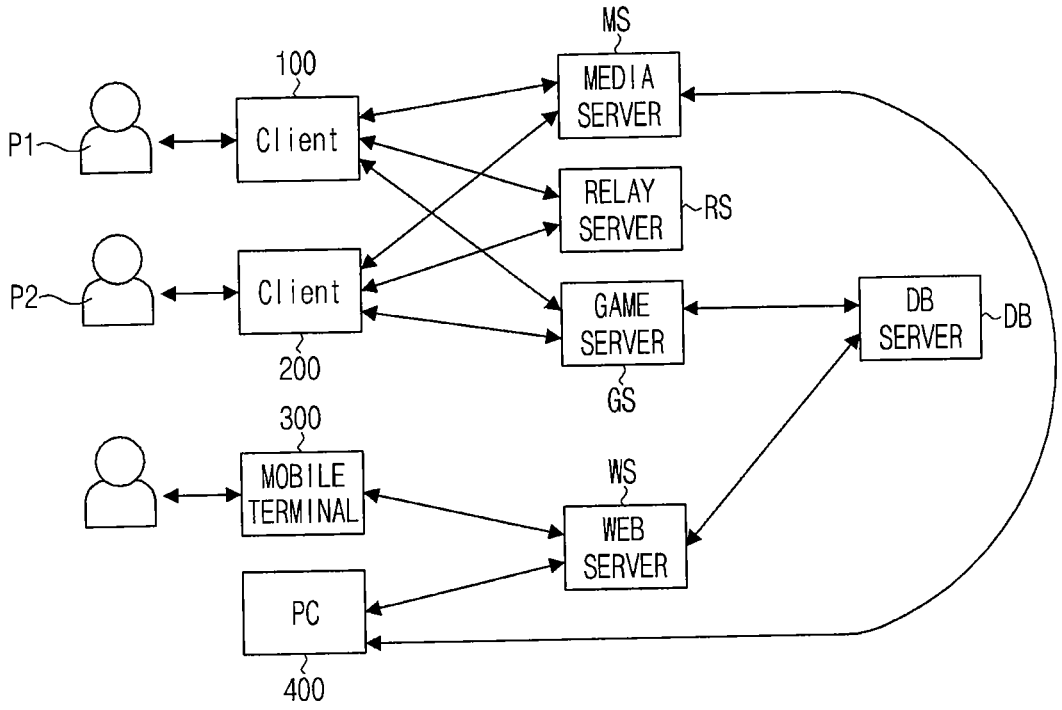
FIG. 2 is a view illustrating the concept of a game network including a game apparatus according to an embodiment of the present invention.

FIG. 2 is a view illustrating the concept of a game network including a game apparatus according to an embodiment of the present invention.

As shown in FIG. 2, the game apparatus 100 used by a first game participant P1 may be one or more servers, which include a media server (MS), a relay server (RS), and a game server (GS), through a network.

A plurality of game participants can enjoy a game at the same time and in the same space by using the same first game apparatus 100. However, when a second game participant P2 remotely located from the first game participant P1 wants to participate in the game, the second game participant P2 may use the second game apparatus 200 to connect with one or more servers including the media server (MS), the relay server (RS), and the game server (GS), through the network, to transmit or receive information to or from the server or servers, and to thereby proceed with the game. The first game apparatus 100 and the second game apparatus 200 may transmit or receive information by means of one or more servers including the media server (MS), the relay server (RS), and the game server (GS), or may directly transmit or receive information to or from each other.

The game may be played either by two game participants P1 and P2 located in different places at the same time or by two game participants P1 and P2 located in different places at different times. Then, the contents of the performance may be stored in the DB server to determine a victory or defeat or determine the ranking thereof.

The media server (MS) may store a dynamic image of the performance of the game participants P1 and P2 stored in the game apparatuses 100 and 200 by using a camera and microphone. The media server (MS) may be included in the DB server.

The relay server (RS) relays the communication between the game apparatuses 100 and 200. The relay server (RS) establishes a communication network between the game apparatuses 100 and 200 spaced from each other, so as to form a peer-to-peer (P2P) network.

The game server (GS) may exchange information (including the scores obtained by the game participants and information for communication between the game participants) between the game apparatuses 100 and 200, may transmit an advantage or a warning based on a game rule through the game apparatuses 100 and 200, or may perform transmission or reception of information necessary for proceeding of the game and a control of the game apparatuses 100 and 200. The game server (GS) may collect information on a victory or defeat of the game and scores of the game participants of the game apparatuses 100 and 200, and may then transmit the collected scores to the DB server.

The DB server may store personal information of the game participants of the game apparatuses 100 and 200, a victory or defeat of the game and ranking information of the game participants, score information of each game, or a replay video of each game. Before storing the information, the DB server may classify the information for each user. The DB server may assign a specific code to each user and manage information of each user by using the specific code. The specific code may be stored in an RFID module possessed by each user, such as an RFID card or an RFID module stored in a mobile terminal. As a result, the game apparatuses 100 and 200 can identify each game participant through the user authentication unit 170 included in each of the game apparatuses 100 and 200. Also, the DB server may assign a specific code for identification to each of the game apparatuses 100 and 200 and may manage the game data according to each identification code assigned to the game apparatuses 100 and 200.

A game participant may access a web server by using a mobile terminal (including an electronic device equipped with a mobile communication function, such as a mobile station, a cellular phone, a PDA, or a PDP) 300 or a personal computer (PC) 400. Further, the web server (WS) may be connected to the game apparatuses 100 and 200 also. The web server (WS) may be connected to the DB server also, so as to provide the game data stored in the DB server to the game participants.

As shown in FIG. 1, the target 110 may include sections divided according to a predetermined rule. For example, in the case of a dart game, the target 110 may include a plurality of sections, which are assigned individual scores and are divided by concentric circles around a bullseye located at a center thereof and straight lines extending radially outward.

In an embodiment of the present invention, the camera unit 150 may include a plurality of cameras 151, 152, . . . , and 153.

The first camera 151 included in the camera unit 150 may be arranged to photograph at least a part of a game participant. For example, in the case of a dart game, the first camera 151 may photograph at least a part of the game participant including the throw line. In the dart game, a determination of whether a game participant has violated a game rule thereof usually depends on a fact of whether the game participant has unrightfully crossed the throw line or not. Therefore, in the case in which the first camera 151 photographs an image frame including the throw line, the first camera 151 may photograph a dynamic image including an image frame indispensable for the determination of whether there is an illegal action made by the game participant.

The second camera 152 may be arranged to photograph at least a part of the target.

Figure 3:
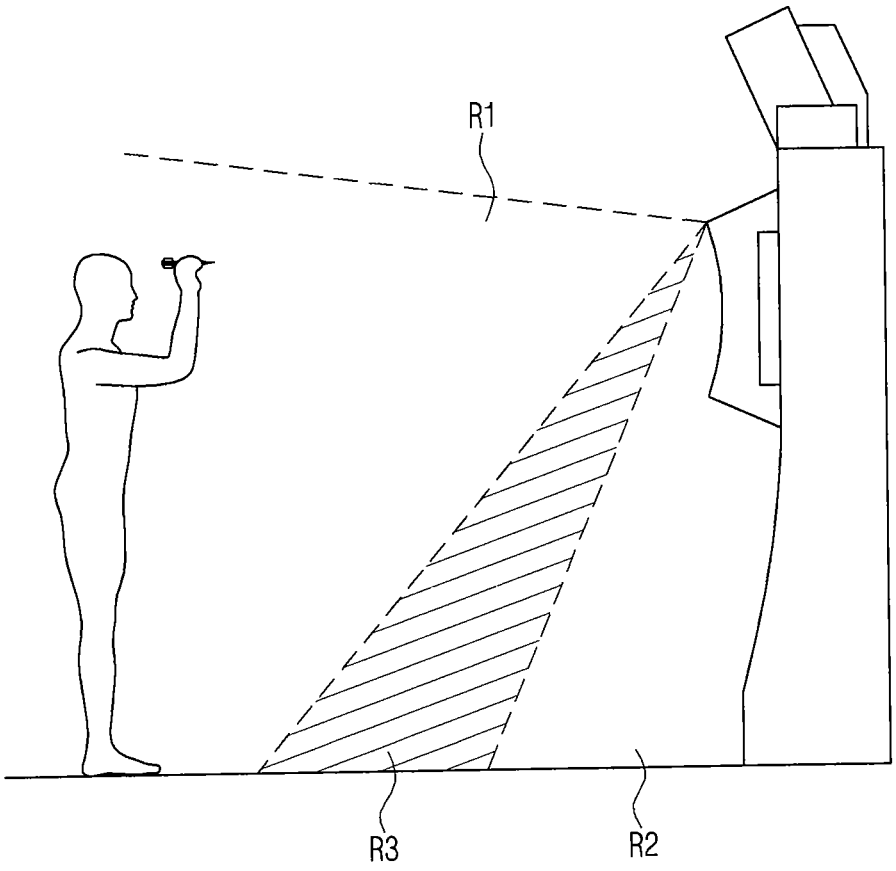
FIG. 3 illustrates a photographing area of the first camera and the second camera.

FIG. 3 illustrates a photographing area of the first camera 151 and the second camera 152.

As noted from dashed lines, the first camera 151 may photograph an area R1 including at least a part of a game participant. As noted from solid lines, the second camera 152 may photograph an area R1 including at least a part of the target.

As shown in FIG. 3, the first camera 151 and the second camera 152 may include a common photographing area R3.

By using the common photographing area R3, the control unit 190 may generate a panorama image in which an image photographed by the first camera 151 and an image photographed by the second camera 152 are consecutively connected to each other.

The memory 180 may store at least a part of the dynamic image photographed by the first camera and the second camera. The dynamic image stored in the memory 180 may be deleted after being transmitted to the outside by the network connection unit 160.

The network connection unit 160 may transmit the dynamic image stored in the memory 180 through the network. The dynamic image may be transmitted to a media server (MS) or to the DB server through the game server (GS).

According to another embodiment of the present invention, the sensing unit 120 may detect a game operation with respect to the target 110. For example, in the case of a dart game, the sensing unit 120 may detect the location on the target in which the dart is stuck, calculate a score corresponding to the location, and then transmit the calculated score to the control unit 190.

The control unit 190 may store dynamic images during a predetermined time interval including a time point at which a game operation (for example, in the case of a dart game, the operation that a dart is stuck in the target 110) is detected by a sensor, in the memory.

According to another embodiment of the present invention, the control unit 190 may detect the time point at which the game operation is performed, by using the dynamic image stored in the memory, and may store dynamic images during a predetermined time interval including a time point at which the game operation is detected by a sensor, in the memory.

By using a conventional image processing technology, the control unit 190 may analyze the dynamic images (for example, in the case of a dart game, if a rapidly moving dart is captured in the dynamic image, it is possible to determine that the game operation has been detected).

The time point at which the game operation is detected may include, for example, a time point at which a basketball makes a contact with a hoop in a basketball game, a time point at which a swing is detected in a golf game, and a firing time point at a shooting game.

Figure 4:
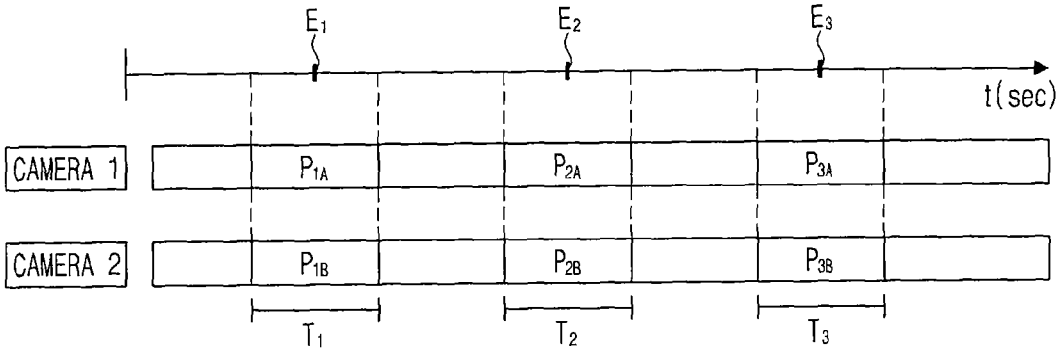
FIG. 4 is a graph showing a process of storing dynamic images during a predetermined time interval, including a time point at which a game operation is detected, in a memory.

FIG. 4 is a graph showing a process of storing dynamic images during a predetermined time interval, including a time point at which a game operation is detected, in a memory.

As shown in FIG. 4, the first game apparatus 100 may detect the time points at each of which a game operation is detected, for example, in the case of a dart game, the time points E1, E2, and E3 at which a dart is stuck in the target, by using the image processing technology of the sensing unit 120 or the control unit 190.

The first game apparatus 100 may store all the dynamic images photographed by the first camera 151 and the second camera 152 by using a buffer configured by a part of the memory 180 or a separate memory.

The control unit 190 may selectively extract dynamic images corresponding to the time intervals T1, T2, and T3 including the time points E1, E2, and E3 at which the game operation is performed from the buffer and then store the extracted dynamic images in the memory 180. The time intervals T1, T2, and T3 may be set either equally or differently with respect to the dynamic images photographed by the first camera 151 and the second camera 152.

For example, the control unit 190 may store all dynamic images photographed by the first camera 151 and the second camera 152 during one second before the execution of the game operation and three seconds after the execution of the game operation, in the memory 180. In contrast, the control unit 190 may store the dynamic images photographed by the first camera 151 during one second before the execution of the game operation and three seconds after the execution of the game operation, in the memory 180, and may store the dynamic images photographed by the second camera 152 during three seconds before the execution of the game operation and one second after the execution of the game operation, in the memory 180.

In the case of dynamic images photographed by one of the first camera 151 and the second camera 152, the control unit 190 may store the dynamic images photographed during a time interval, which do not include the time points E1, E2, and E3 at which the game operation is performed, in the memory 180.

For example, the control unit 190 may store the dynamic images photographed by the second camera 152 during a time interval from three seconds to six seconds after the execution of the game operation, in the memory 180.

Hereinafter, an embodiment of generating and storing dynamic images including a score of a game operation will be described in detail with reference to the drawings.

Figure 5:
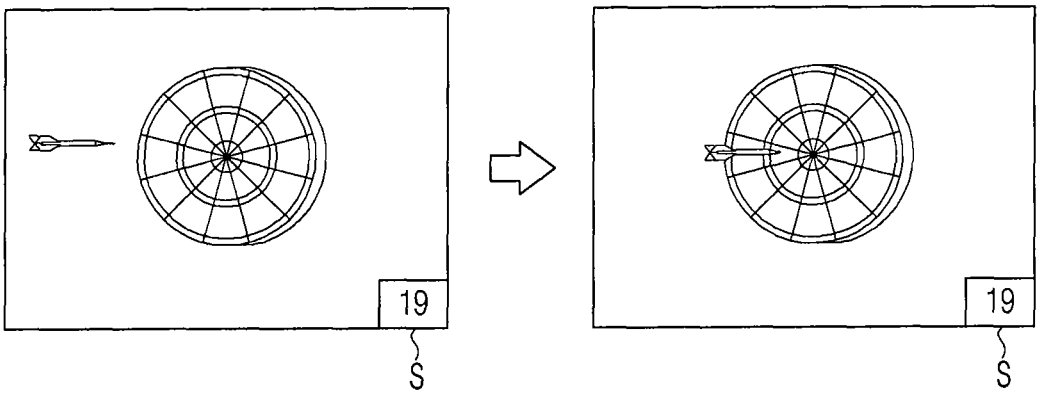
FIG. 5 illustrates stored dynamic images including scores of game operations.

FIG. 5 illustrates stored dynamic images including scores of game operations.

According to another embodiment of the present invention, the control unit 190 may calculate a score by evaluating a game operation with respect to the target 110, generate a dynamic image including the calculated score displayed on a part of the dynamic image, and store the generated dynamic image in the memory 180.

As shown in FIG. 5, for example, in the case of a dart game, the control unit 190 may provide a score for a game operation. For example, when the dart is stuck in the area corresponding to 19 points in the target 110, the control unit 190 may provide a score of 19 points for the game operation.

By using the dynamic images stored in the memory 180, the control unit 190 may generate a dynamic image including the provided score S displayed on a part of the dynamic image. The score S may be disposed at a corner portion of a screen or may be displayed in a transparent shape, so as to prevent the score S from overlapping with an important scene of the game operation.

Hereinafter, an embodiment for a primary authentication of the game operation through a user authentication unit will be described in detail.

Figure 6:
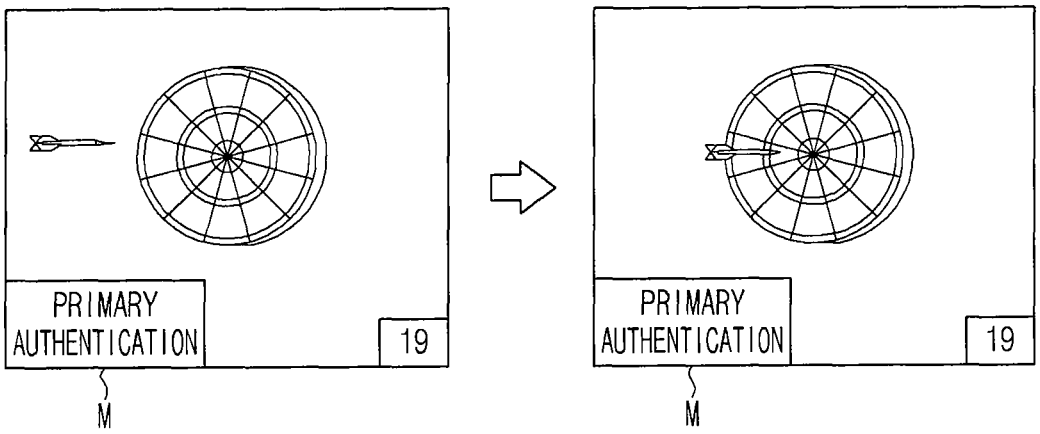
FIG. 6 illustrates game dynamic images, a primary authentication of which has been completed.

FIG. 6 illustrates game dynamic images, a primary authentication of which has been completed.

Figure 7:
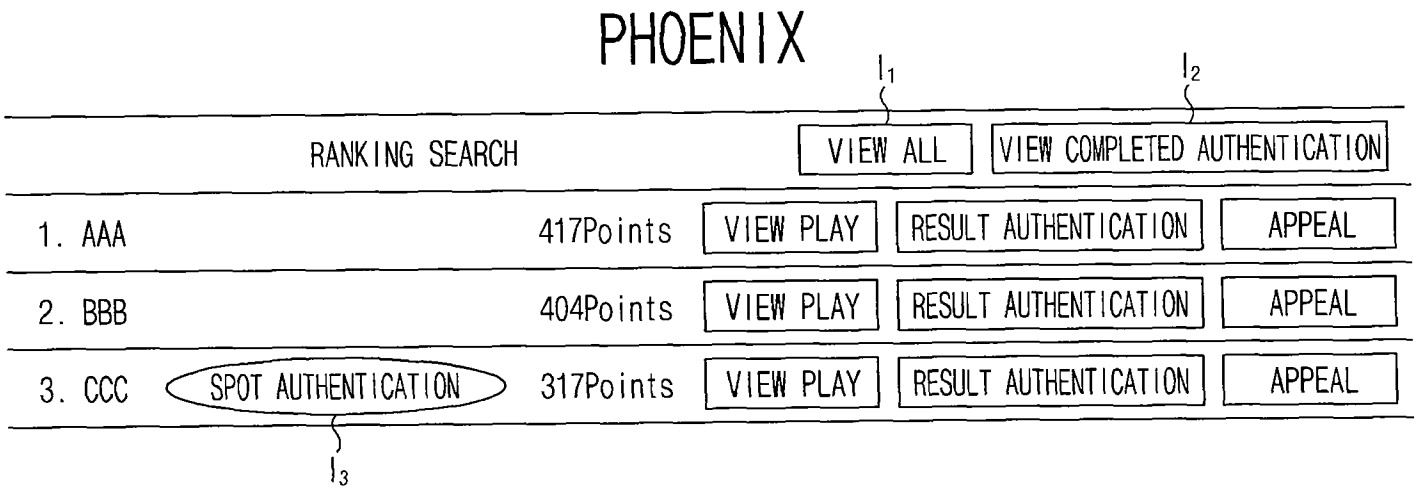
FIG. 7 illustrates a web page showing a game result, a primary authentication of which has been completed.

FIG. 7 illustrates a web page showing a game result, a primary authentication of which has been completed.

In another embodiment of the present invention, after the game operation is performed, specific information of another game participant who has not performed a game operation yet may be received by the user authentication unit 170. In this event, the control unit 190 considers that a primary authentication of the dynamic images including the game operation has been completed.

When a third party located at the same place as that of a game participant has identified the performance of the game participant with his or her eyes and has evaluated the performance as a rightful action, the third party may input his or her own specific information through the user authentication unit 170. In this event, the memory 180 may determine this game data as game data having a high reliability and may determine that a primary authentication of the data has been completed.

When generating the dynamic images for authentication of the game play, the memory 180 may display the primary-authenticated dynamic images in a manner capable of discriminating the primary-authenticated dynamic images from the other dynamic images.

As shown in FIG. 6, for the primary-authenticated dynamic images, the control unit 190 may generate an indication notifying that the dynamic images have been primary authenticated, add the generated indication to the primary-authenticated dynamic images, and then store the dynamic images in the memory 180.

The servers (including the GS, the DS, the RS, and the MS) as described above may manage the primary-authenticated dynamic images in a manner capable of discriminating the primary-authenticated dynamic images from the other dynamic images.

As shown in FIG. 7, the game participant may read his or her own game data or game data of another game participant through a web server. Through the web server, the game participant may view game dynamic images of another game participant and may monitor whether the game data of another game participant has been established by an illegal action or not.

The web server (WS) may approve game data satisfying a preset criterion (for example, data authenticated by at least a predetermined number of people or data authenticated by users (such as a referee) having an authority provided by a server) as authenticated formal game data. The web server (WS) may separately manage the formal game data.

When the user has selected an icon I1, the web server (WS) may provide a web page displaying all game data and rankings based on both already-authenticated game data and game data not authenticated yet.

When the user has selected an icon I2, the web server (WS) may provide a web page displaying game data and rankings in consideration of only already-authenticated game data.

The web server (WS) may provide a web page including an icon I3 for displaying primary-authenticated game data.

According to another embodiment of the present invention, the control unit 190 may schedule the transmission time of dynamic images according to the state of the network connected with the first game apparatus 100. The network connection unit 160 may transmit dynamic images stored in the memory 180 according to the scheduling. In this event, the control unit 190 may schedule the transmission time of dynamic images in consideration of one or more combinations of the traffic quantity of the network, a condition of whether it is possible to access the network, and a network accessible time.

Hereinafter, a method of authenticating game data of a game apparatus according to an embodiment of the present invention will be described in detail with reference to the drawings.

Figure 8:
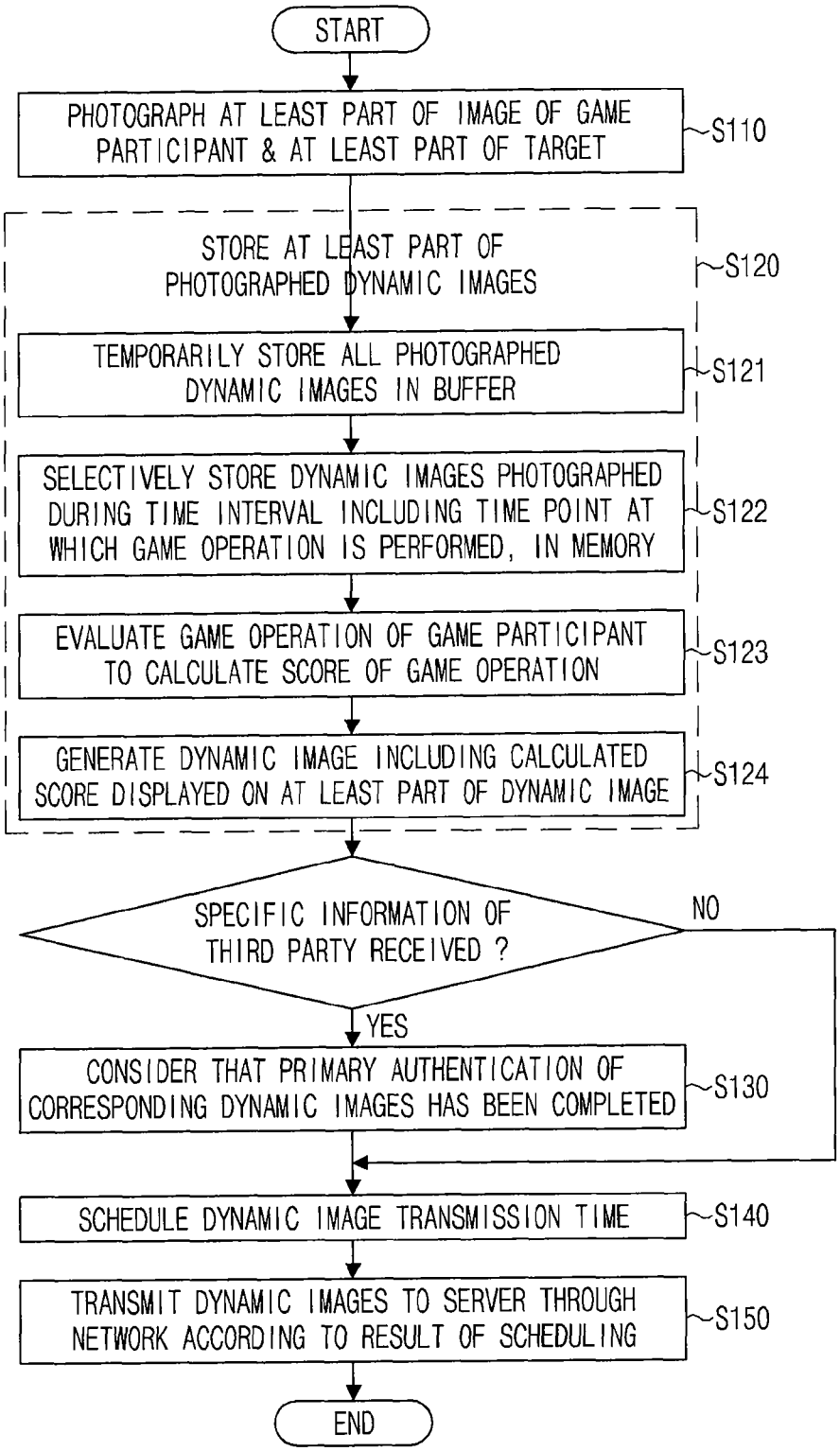
FIG. 8 is a signal flow diagram illustrating a method of authenticating game data of a game apparatus according to an embodiment of the present invention.

FIG. 8 is a signal flow diagram illustrating a method of authenticating game data of a game apparatus according to an embodiment of the present invention.

The game apparatus 100 photographs at least a part of an image of a game participant and at least a part of a target (step S110). Then, the game apparatus 100 stores at least a part of the photographed dynamic images (step S120). The camera or cameras may be arranged, for example, to photograph a throw line in a dart game or to have a common photographing zone shared by a plurality of cameras.

In storing at least a part of the photographed dynamic images, the game apparatus 100 may temporarily store all the photographed dynamic images in a buffer (step S121). Among the dynamic images temporarily stored in the buffer, the game apparatus 100 may selectively store dynamic images photographed during a time interval including a time point at which a game operation is performed, in a memory (step S122).

Then, the game apparatus 100 may evaluate the game operation of the game participant to calculate a score of the game operation (step S123). Subsequently, the game apparatus 100 may generate a dynamic image including the calculated score displayed on at least a part of the dynamic image (step S124).

After the game operation relating to the generation of the dynamic images is performed, when specific information of a third party has been received through the user authentication unit 170, the game apparatus 100 may consider that a primary authentication of the dynamic images corresponding to the game operation has been completed.

The primary authentication may be either repeatedly performed for every game operation or collectively performed once for each single game after said each single game is completed.

When specific information of a third party is not received through the user authentication unit 170, the game apparatus 100 proceeds to the next step (S140) without performing the primary authentication.

Then, the game apparatus 100 may schedule the dynamic image transmission time (step S140), and may transmit the dynamic images to a server through the network according to the result of the scheduling (step S150).

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill in the art would further appreciate that the various illustrative logical blocks, modules, processors, means, circuits, and algorithm steps described in connection with the aspects disclosed herein may be implemented as electronic hardware, various forms of program or design code incorporating instructions (which may be referred to herein, for convenience, as "software" or a "software module"), or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the aspects disclosed herein may be implemented within or performed by a general purpose processor, a digital signal processor (DSP), an application specific integrated circuit (ASIC), a field programmable gate array (FPGA) or other programmable logic device, discrete gate or transistor logic, discrete hardware components, or any combination thereof. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

It is understood that any specific order or hierarchy of steps in any disclosed process is an example of a sample approach. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

The steps of a method or algorithm described in connection with the aspects disclosed herein may be embodied directly in hardware, in a software module executed by a processor, or in a combination of the two. A software module (e.g., including executable instructions and related data) and other data may reside in a data memory such as RAM memory, flash memory, ROM memory, EPROM memory, EEPROM memory, registers, a hard disk, a removable disk, a CD-ROM, or any other form of storage medium (e.g., a computer-readable storage medium) known in the art. A sample storage medium may be coupled to a machine such as, for example, a computer/processor (which may be referred to herein, for convenience, as a "processor") such that the processor can read information (e.g., software commands) from and write information to the storage medium. A sample storage medium may be integral to the processor. The processor and the storage medium may reside in an ASIC. The ASIC may reside in user equipment. In the alternative, the processor and the storage medium may reside as discrete components in user equipment.

In one or more illustrative designs, described technologies may be implemented by hardware, software, firmware, or any combination thereof. If they are implemented by software, functionalities thereof may be stored in a computer-readable medium, may be stored as one or more instructions through a computer-readable medium, or may be coded on a computer-readable medium. The computer-readable medium includes both a communication medium and a computer storage medium including any medium facilitating transmission of a computer program from one place to another place. The storage medium may be any available medium which can be accessed by a general purpose computer or a special purpose computer. By way of example, without limitation, such a computer-readable medium may include any other medium, which can be accessed by RAM, ROM, EEPROM, CD-ROM or other optical disc storage space, magnetic field storage space or other magnetic field storage space devices, general purpose or special purpose computers, or general purpose or special purpose processors, and can be used to carry or store a program code means required in the form of instructions or data structures. Further, all connections are properly terminated by a computer-readable medium. For example, if software is transmitted from a web site, server, or another remote source by using a coaxial cable, an optical fiber cable, a twist pair, a digital subscriber line (DSL), or wireless technologies, such as infrared rays transmission, wireless transmission, and microwaves transmission, the definition of the medium includes the twist pair, the digital subscriber line (DSL), or the wireless technologies, such as infrared rays transmission, wireless transmission, and microwaves transmission. As used herein, a disk or disc includes a compact disc (CD), a laser disc, an optical disc, a DVD, a floppy disc, and a Blue-ray disc, wherein the discs optically reproduce data through a laser while it is usual that disks magnetically reproduce data. Combinations of those described above may also be included in the range of the computer-readable medium.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A dart game apparatus, comprising:

a target comprising a plurality of sections divided according to a predetermined principle;

a camera unit comprising a first camera and a second camera, the first camera being arranged to capture images of at least a part of a game participant and a throw line of a dart game, the second camera being arranged to capture images of at least a part of the target;

a memory for storing at least a part of dynamic images captured by the first camera and the second camera;

a network connection unit for transmitting the dynamic images stored in the memory to a network; and a control unit for controlling operations of the first camera and the second camera and transmission of the dynamic images, wherein the first camera and the second camera are disposed adjacent, wherein an angle of the first camera is arranged to capture images of at least a part of a game participant and a throw line of a dart game, wherein an angle of the second camera is arranged to capture images of at least a part of the target, wherein an angle between the first camera and the second camera is determined to capture images that are needed to determine whether the game participant has performed an illegal action in the dart game, wherein the first camera and the second camera are arranged between the throw line and the target, wherein, after a game operation is performed, the control unit is configured to:

receive information of a third party who has not performed the game operation;

then complete a primary authentication of dynamic images including the performed game operation; and indicate the primary-authenticated dynamic images in a manner capable of discriminating the primary-authenticated dynamic images from the other dynamic images.

2. The dart game apparatus as claimed in claim 1, further comprising a sensing unit for detecting a game operation with respect to the target, wherein the control unit stores dynamic images captured during a predetermined time interval including a time point at which the game operation is detected by the sensing unit, in the memory.

3. The dart game apparatus as claimed in claim 1, wherein the control unit detects a time point at which a game operation is performed, by using the dynamic images stored in the memory, and stores dynamic images captured during a predetermined time interval including the time point at which the game operation is performed, in the memory.

4. The dart game apparatus as claimed in claim 1, wherein the control unit calculates a score by evaluating a game operation with respect to the target, generates a dynamic image including the calculated score to be displayed on a part of the generated dynamic image, and stores the generated dynamic image in the memory.

5. The dart game apparatus as claimed in claim 1, further comprising a user authentication unit capable of recognizing information of a game participant.

6. The dart game apparatus claimed in claim 5, wherein the information of the game participant comprises an identifier (ID) stored in a Radio Frequency Identification (RFID) card, and the user authentication unit comprises an RFID card reader.

7. The dart game apparatus as claimed in claim 5, wherein, after a game operation is performed, the user authentication unit receives specific information of a third party who has not performed the game operation, and when the specific information of the third party has been received, the control unit processes dynamic images including the game operation as such that a primary authentication of the dynamic images including the game operation has been completed.

8. The dart game apparatus as claimed in claim 1, wherein the control unit performs a scheduling of a transmission time of dynamic images according to a state of the network, and the network connection unit transmits the dynamic images according to the scheduling of the control unit.

9. The dart game apparatus as claimed in claim 8, wherein the control unit performs the scheduling of the transmission time in consideration of one or more combinations of a traffic quantity of the network, a condition of whether it is possible to access the network, and a network accessible time.

10. The dart game apparatus as claimed in claim 1, wherein the first camera and the second camera share a common image capturing area.

11. A dart game apparatus, comprising:

a target comprising a plurality of sections divided according to a predetermined principle;

a first camera configured to capture at least a part of a game participant and a throw line of a dart game, and a second camera configured to capture at least a part of the target;

a memory configured to store at least a part of dynamic images captured by the first camera and the second camera;

a network connection unit configured to transmit the dynamic images stored in the memory to a server via a network; and a control unit configured to control operations of the first camera and the second camera and transmission of the dynamic images, wherein the first camera and the second camera are disposed adjacent, wherein an angle of the first camera is arranged to capture images of at least a part of a game participant and a throw line of a dart game, wherein an angle of the second camera is arranged to capture images of at least a part of the target, wherein an angle between the first camera and the second camera is determined to capture images that are needed to determine whether the game participant has performed an illegal action in the dart game, wherein the first camera and the second camera are arranged between the throw line and the target, wherein, after a game operation is performed, the control unit is configured to:

receive information of a third party who has not performed the game operation;

then complete a primary authentication of dynamic images including the performed game operation; and indicate the primary-authenticated dynamic images in a manner capable of discriminating the primary-authenticated dynamic images from the other dynamic images.

12. The dart game apparatus as claimed in claim 11, further comprising a sensing unit configured to detect a game operation with respect to the target, wherein the control unit is further configured to store, in the memory, dynamic images captured during a predetermined time interval including a time point at which the game operation is detected by the sensing unit.

13. The dart game apparatus as claimed in claim 11, wherein the control unit is further configured to calculate a score by evaluating a game operation with respect to the target, generate a dynamic image including the calculated score on a part of the generated dynamic image, and store the generated dynamic image in the memory.

14. The dart game apparatus as claimed in claim 11, further comprising a user authentication unit configured to recognize information of a game participant.

15. The dart game apparatus claimed in claim 14, wherein the user authentication unit comprises a Radio Frequency Identification (RFID) card reader, and wherein the information of the game participant comprises an identifier (ID) stored in an RFID (Radio Frequency Identification) card.

16. The dart game apparatus as claimed in claim 11, wherein the control unit is further configured to determine whether the game participant has overstepped the throw line or not, based on the dynamic images captured by the first camera.

17. The dart game apparatus as claimed in claim 11, wherein the first camera and the second camera are configured to simultaneously capture the dynamic images.

18. The dart game apparatus as claimed in claim 11, wherein the first camera and the second camera are configured to simultaneously capture different dynamic images.

19. The dart game apparatus as claimed in claim 11, wherein the control unit is further configured to determine whether the game participant made an illegal action of the dart game based on the dynamic images captured by the first camera, and determine a score of the dart game based on the dynamic images captured by the second camera.

* * * * *